US006199614B1

(12) United States Patent
Snyder et al.

(10) Patent No.: US 6,199,614 B1
(45) Date of Patent: Mar. 13, 2001

(54) HIGH SPEED LABELING MACHINE HAVING A CONSTANT TENSION DRIVING SYSTEM

(75) Inventors: Ronald E. Snyder, York, PA (US); Robert C. Jenness, Jr., Westminster, MD (US); George W. Baker, Jr., York, PA (US)

(73) Assignee: Exact Packaging, Inc., New Freedom, PA (US)

( * ) Notice: Subject to any disclaimer, the term of this patent is extended or adjusted under 35 U.S.C. 154(b) by 0 days.

(21) Appl. No.: 08/193,654

(22) Filed: Feb. 3, 1994

(51) Int. Cl.[7] ..... B65C 9/00

(52) U.S. Cl. ..... 156/387; 156/384; 156/494; 156/495; 156/496; 156/542

(58) Field of Search ..... 156/542, 494, 156/495, 496, 384, 387; 226/44; 242/417.6, 413.6, 416, 417

(56) References Cited

U.S. PATENT DOCUMENTS

| | | | | |
|---|---|---|---|---|
| 2,229,480 | * | 1/1941 | Spencer et al. | 242/413.6 |
| 3,318,544 | * | 5/1967 | Jones | 242/413.6 X |
| 3,321,105 | | 5/1967 | Marano | 156/542 |
| 3,381,913 | * | 5/1968 | Bachman | 242/417 X |
| 4,239,569 | * | 12/1980 | Harvey | 156/542 X |
| 4,383,880 | * | 5/1983 | Geurtsen et al. | 156/542 X |
| 4,735,664 | * | 4/1988 | Asghar et al. | 156/542 X |
| 4,763,823 | | 8/1988 | Eder et al. | 226/109 |
| 4,855,005 | * | 8/1989 | Jodrey | 156/361 |
| 4,954,203 | * | 9/1990 | Matsumoto | 156/542 X |
| 5,022,954 | | 6/1991 | Plaessmann | 156/542 |
| 5,230,765 | * | 7/1993 | Weiselfish et al. | 156/542 X |

FOREIGN PATENT DOCUMENTS

| | | | | |
|---|---|---|---|---|
| 319775 | * | 6/1989 | (EP) | 242/413.6 |

* cited by examiner

*Primary Examiner*—Richard Crispino
(74) *Attorney, Agent, or Firm*—Nixon Peabody LLP; Tim L. Brackett, Jr.

(57) ABSTRACT

A high speed labeling machine is provided which includes a constant tensioning device for maintaining tension downstream of the metering roll at a substantially constant predetermined level thereby improving both metering and dispensing of labels. The constant tensioning device may also function as a driver for pulling the continuous web of material through the labeling machine thereby reducing the driving load on the metering roll, thus both providing more effective and accurate metering at a given web speed while also allowing higher web speeds to be achieved.

21 Claims, 2 Drawing Sheets

HIGH SPEED LABELING MACHINE HAVING A CONSTANT TENSION DRIVING SYSTEM

TECHNICAL FIELD

This invention relates to an improved high speed labeling system having a constant tension driving system capable of maintaining a substantially constant tension in the web material so as to ensure accurate metering of the web and effective dispensing of labels.

BACKGROUND OF THE INVENTION

The application of labels to articles and products has been and continues to be an important step in providing product identification, specific product information and marketing advantages. Manufacturers of various products are continually seeking a more efficient and effective manner in which to apply labels to articles or items, such as cartons, containers or any other packages or products Laving a surface capable of securely receiving an adhesive label.

Numerous methods have been employed in the past to mark articles, such as color-coded ink sprays and manually applied stickers. The introduction of adhesive-backed pressure sensitive labels and hand-held, manually operated applicators has greatly facilitated the marking of articles in that the applicators provide a simple means for applying an adhesive-backed label to an article. Such hand-held label applicators are well known and used extensively in various industries, for example, for marking the price of articles to be sold. Their use, however, in manufacturing, assembling and distributing applications is limited because of the necessity for marking many items at a high rate of speed. In these applications, the articles to be labeled are transported along a conveyor past a number of stations, one of which often entails the application of a label to each article as it passes by or while the conveyor is stopped. Use of a hand-held label applicator in this type of high speed operation would be unacceptably slow, inefficient, labor intensive and therefore, inipractical due to the time constraints associated with high volume production.

As a result, relatively high speed labeling machines have been developed to apply labels to articles advancing by a labeling station on, for example, a conveyor belt. The pressure-sensitive labels are commonly precut and carried on a continuous web of material often called backing material which is rolled into a roll for mounting on the labeling machine. The backing material is somewhat more flexible than the label itself. This allows the label to be separated from the backing material, or dispensed, simply by bending the backing material sharply away from the label, which is usually done by drawing the backing over a fairly sharp stripping or peeling edge of a peeling bar or plate. The less flexible label then separates from the backing material and remains relatively straight for application to the article by some type of applicator. For example, U.S. Pat. Nos. 3,321,105 to Marano and 5,022,954 to Plaessmann disclose automated labeling machines which operate at relatively high speed when compared to manual application.

Although some present labeling machines function adequately at certain high speeds, there is an ongoing need for labeling machines capable of labeling at extremely high speeds so as to increase the number of labels applied per unit time, thereby increasing the efficiency of the manufacturing process. One method of increasing the labeling capacity of a machine is to increase the speed at which the web moves through the machine. The higher the moving or feed speed of the web through the machine, the greater the number of labels dispensed per unit time. A common form of driving means for pulling the web through the labeling machine is a nip roller assembly driven by, for example, a stepper motor such as disclosed in both Marano '105 and Plaessmann '954. The web passes through a nip formed between a driver roller, powered by the stepper motor, and a driven or nip roller biased against the driver roller. In this manner, the rollers engage the web so that intermittent operation of the stepper motor causes intermittent movement of the web through the labeling machine. Increasing the speed of the stepper motor will, therefore, increase the speed of the web through the dispenser, i.e., over the peeler bar. However, the web feed speed will certainly be limited by the maximum operational speed and capacity of the driver of the nip roller assembly. Although a single driving device, such as a stepper motor, capable of achieving higher speeds and torque capacities, may be available, these drivers are often too large and too expensive. Therefore, it has been found that many labeling machines are incapable of achieving extremely high labeling speeds while minimizing costs. Moreover, as with the labelers disclosed in Marano '105 and Plaessmann '954, the nip roll assembly is often used as both a driving means and a metering means. In this instance, the driver roller must function to both pull the web through the machine while also stopping and starting the movement of the web so as to properly meter the correct length of web over the peeler bar as required to dispense the next label(s). However, the ability of the nip roll assembly to accurately and effectively meter the proper length of web is impaired, especially at high speeds, by the requirement of the assembly to also provide the pulling force necessary to pull the web through the machine. As a result, at very high speeds, these driving and metering nip roll assemblies often fail to provide accurate and effective metering of the web.

The labeling machines disclosed in Marano '105 and Plaessmann '954 include a tensioning device downstream of the metering roll for maintaining a continuous tension in the web between the metering roll and a take-up drum. Specifically, the Marano tensioning device is a slipping belt/pulley arrangement attached to a take-up drum for continually rotating the take-up drum with a light rotational load. The Plaessmann reference discloses an idler arm-type assembly positioned between the metering roll and take-up drum for applying a light tensioning load to the web. In both embodiments, the tensioning device functions as a speed compensator between the take-up drum and the metering roll which do not move in complete synchronization. In this manner, the slip belt/pulley device and the idler arm device both insure that there are no loops or kinks in the web before it goes to the take-up drum by maintaining a continuous tension in the web. However, the continuous tension in the web caused by these tensioning devices varies throughout the operation of the labeling machine. As the web material accumulates on the take-up drum, the diameter of the take-up roll of material gradually increases, thereby continually increasing the moment arm through which the accumulating force of the take-up drum acts on the web. As a result, the force applied on the web by the take-up drum gradually decreases as the diameter of the roll increases, thus gradually decreasing the tension in the web. Also, the spring force biasing the idler arm of the Plaessmann '954 device varies throughout movement of the arm thus varying the tension in the web. Moreover, the continuous stopping and starting of the metering roll causes variations in the web tension downstream of the metering roll. These variations in web tension downstream of the driving and metering roll cause undesirable variations in web tension through the labeling machine. These tension variations adversely affect the ability of the metering roll to accurately and effectively meter the web thereby also adversely affecting ihe dispensing of labels by, for example, failing to pull the proper length of web across the peeler bar. Moreover, the web tension variations felt upstream at the peeler bar disadvantageously affect the dispensing of labels by making it more difficult for the metering means to accurately and repeatedly pull the web over the peeler bar with the optimum amount of constant web tension necessary for effective dispensing of labels at a given web speed. In addition, the above-noted adverse affects of web tension variations are exacerbated at higher web speeds at which substantially constant web tension becomes critical to achieving accurate metering and dispensing of labels.

Many labeling machines also include a printing device upstream of the dispenser for printing indicia on the labels as the web passes through the printer. The printing devices used are often "off-the-shelf" items having a metering/driving roll incorporated therein. As a result, it is often more cost effective and easier to use this existing metering/driving roll as the primary metering/driving roll for the labeling machine. However, the driver for the driving/metering roll found in many printers often lacks the power/torque capable of: 1) accurately metering the web at higher web speeds while maintaining high printing quality; and/or 2) creating a pulling force sufficient to overcome the inertia of a large supply roll of continuous web, as used in large capacity labeling, so as to effectively pull the web from the supply roll while accurately metering the web.

SUMMARY OF THE INVENTION

It is an object of the present invention, therefore, to overcome the disadvantages of the prior art and to provide a labeling machine capable of accurately and effectively metering and applying labels to articles at a very high speed.

It is another object of the present invention to provide a labeling machine with a constant tension driving system capable of maintaining a substantially constant tension in the web material downstream of the metering roll so as to ensure accurate metering and effective dispensing of labels.

It is yet another object of the present invention to provide a labeling machine having a constant tension driving system which reduces the driving load on the driver/metering roll to allow the metering roll to more accurately meter the web while achieving the same web speed.

It is a further object of the present invention to provide a high speed labeling machine with a constant tension system capable of maintaining substantially constant tension in the web between the driving roll and the take-up drum to minimize tension variations in the web throughout the labeling machine.

Still another object of the present invention is to provide a labeling machine capable of achieving higher labeling or web speeds while providing effective metering and dispensing of labels.

Yet another object of the invention is to provide a labeling machine for printing and dispensing labels which permits the metering roll of an "off-the-shelf" printer to be used as an effective driving and metering roll for high capacity labeling.

A further object of the invention is to provide a labeling machine with a constant tension driving system which maintains tension in the web material downstream of the metering roll and the label dispenser at substantially constant levels.

Still yet another object of the present intention is to provide a high-speed labeling machine capable of effectively maintaining the proper amount of tension in the continuous web of labeling material to effect the proper dispensing.

A further object of the present invention is to provide a high-speed labeling machine which minimizes the required tension force applied to the web of backing material necessary for dispensing each label.

Another object of the present invention is to provide a high-speed labeling machine capable of minimizing the frictional forces applied to the web by the peeler bar while ensuring effective label dispensing.

Yet another object of the present invention is to provide a labeling and printing machine which permits more effective and consistent printing of labels throughout operation.

A further object of the present invention is to provide a labeling and printing machine which minimizes tension variations in the web at the printer, thereby allowing more effective and consistent printing.

These and other objects are achieved by providing a labeling machine for dispensing labels from a continuous web of material traveling along a feed path and applying the labels to a plurality of articles, comprising a supply roll for providing a supply of the continuous web of material having the labels affixed thereto, a dispenser positioned along the feed path downstream of the supply roll for removing the labels from the continuous web, a metering roll positioned along the feed path for metering the web from the supply roll and a constant tensioning device positioned along the feed path downstream of the metering roll for maintaining tension in the web immediately downstream of the metering roll at a substantially constant predetermined level. The constant tensioning device may also function as a driving device for imparting a pulling force on the continuous web of material for pulling the material from the supply means thereby assisting an upstream driving device. The metering roll may function as the upstream driving device and the labeling machine may further include a take-up drum downstream of the dispenser for accumulating the web material. The metering and driving roll may be positioned along the feed path, either between the supply roll and the dispenser or between the dispenser and the take-up drum. Preferably, the pulling force supplied by the constant tensioning device equals at least 20% of the total pulling force necessary to pull a given web through the labeling machine at a given speed. The substantially constant pulling force imparted by the constant tensioning device may be equal to approximately one-half the maximum driver pulling force imparted on the web by the driving and metering roll at full capacity. The labeling machine may include a printer positioned upstream of the dispenser for printing indicia on the labels. The constant tensioning device may be a power dancer positioned along the feed path between the dispenser and the take-up drum. The power dancer may include a lever arm having a roller mounted on one end thereof and a biasing spring operatively connected to the lever arm for biasing the arm against the web of material. The lever arm may be pivotable between two positions so as to allow the spring to move the arm as the web is indexed through the metering roll. The take-up drum may be operable to move the lever arm back to the first position upon reaching the second position thereby recocking the arm. The dispenser may include a peeler bar having a peeling edge for contacting the web of material so as to cause the label to dispense from the web. A rotatable roller may be positioned immediately adjacent the peeling edge of the bar for supporting the portion of the web exiting the peeler bar thereby reducing frictional forces across the peeler bar.

DETAILED DESCRIPTION OF THE PREFERRED EMBODIMENT

Figure 1:
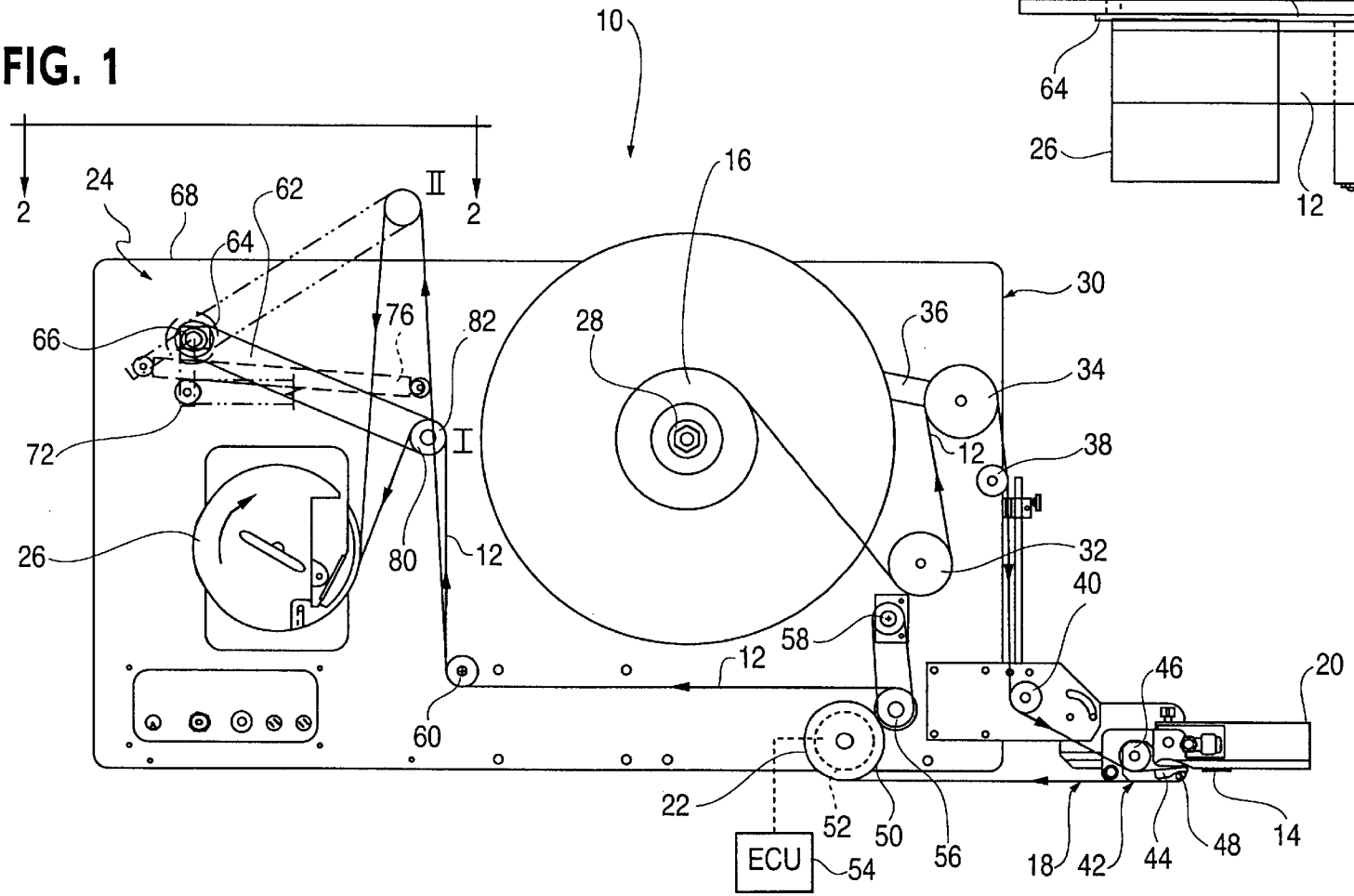
FIG. 1 is a front elevational view of the high speed labeling machine of the present invention.

Referring to FIG. 1, there is shown the high speed labeling machine of the present invention indicated generally at 10 for accurately metering a continuous web of material 12 while effectively dispensing labels 14 for application to various items or articles (not shown). Labeling machine 10 generally includes a supply roll 16 of labels affixed to the continuous web of backing material 12, a dispensing unit 18 for removing the labels from the backing material 12, an applicator 20 for applying the labels to the articles, a driving and metering roll 22 for pulling the web from supply roll 16 in accurately metered lengths so as to dispense labels 14 as needed, a constant tensioning device 24 for assisting the driving and metering roll 22 in pulling the web through the labeling machine while maintaining substantially constant tension downstream of the driving and metering roll 22, and an accumulating or take-up drum 26 for accumulating the waste backing material.

Supply roll 16 is rotatably mounted on a spindle 28 extending from a main support frame 30 of labeling machine 10. The web 12 from supply roll 16 passes around a first idler roller 32 and extends upwardly toward a second idler roller 34. Web 12 then passes over second idler roller 34 downwardly toward dispensing unit 18. Idler roller 34 is mounted on a conventional idler arm 36 biased upwardly by a small biasing force created by for example, a biasing spring. The lightly loaded idler arm 36 maintains a minimal amount of tension in web 12 so as to ensure smooth, taut delivery of web 12 to dispensing unit 18.

Two small idler rollers 38 and 40 direct the downwardly fed web toward dispensing unit 18. Dispensing unit 18 includes a dispensing device in the form of a peeler bar assembly 42 which includes a peeler bar 44 having a peeling edge against which the web is moved to separate the label from the web of backing material. A delivery roller 46 mounted on dispensing unit 18 directs web 12 toward peeler bar 44. A rotatable reduction roller 48 mounted on unit 18 and positioned immediately adjacent the portion of the web exiting the peeling edge of peeler bar 44, is positioned to receive the exiting portion of the web to minimize the frictional forces on the web as it is pulled over the peeling edge, thereby minimizing the required tension in the web necessary to effectively dispense labels 14. Applicator 20 may be any conventional applicator device for applying labels 14 to articles. For example, applicator may be a conventional vacuum blow applicator which alternates between creating a vacuum for acquiring labels dispensed from peeler bar 44 and supplying pressurized air for blowing the dispensed labels onto articles at the appropriate moment.

As shown in FIG. 1, driving and metering roll 22 includes a driver roller 50 operated by, for example, a stepper motor 52 controlled by an electronic control unit (ECU) 54. ECU 54 controls driver roller 50 so as to rotate and pull the web through the nip formed between driver roller 50 and a nip roller 56 biased against driver roller 50 by a biasing spring 58. An idler roller 60 mounted on main support 30 receives the web from nip roller 56 of driving and metering roll 22 and directs the web upwardly toward constant tensioning device 24 and take-up drum 26.

Figure 2:
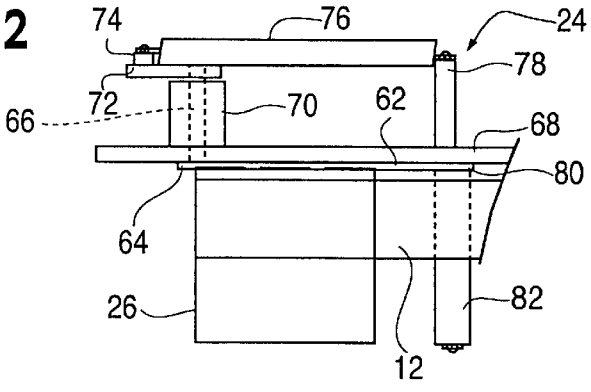
FIG. 2 is a top plan view of the constant tensioning and driving device of the present invention taken along plane 2—2 of FIG. 1.

As shown in FIGS. 1 and 2, constant tensioning device may be in the form of a power dancer device 24 including a pivotable lever arm 62 rotatably mounted at a fixed end 64 to main support 30 by a pin 66. The pin 66 extends through a support wall 68 of main support 30 and through the center of a spacer collar 70. Pin 66 extends outwardly from spacer collar 70 to connect with a pivotable link 72 on the opposite side of support wall 68. Lever arm 62 and link 72 are both rigidly attached to pin 66 so that movement of either arm 62 or link 72 causes corresponding movement of the other. The outward end of link 72 includes an extension pin 74 which extends laterally outward from link 72. Power dancer 24 also includes a biasing means, such as a coil spring 76, which connects at one end to extension pin 74. The opposite end of spring 76 connects to one end of a support rod 78 which extends laterally from, and is rigidly attached to, support wall 68. Lever arm 62 also includes a pivotable end 80 having a link roller 82 connected thereto and extending laterally outwardly for supporting the web received from idler roller 60 and redirecting the web toward take-up drum 26. As described more fully hereinbelow, power dancer device 24 is designed so that a substantially constant load is placed on the web by the biasing force of spring 76 acting through link 72 and lever arm 62 throughout the movement of arm 62.

Take-up drum 26 is mounted on a rotatable shaft of a motor which operates to rotate drum 26 in the clockwise direction as shown in FIG. 1 for accumulating the waste backing material into a roll. Drum 26 is intermittently operated depending on the position of pivotable lever arm 62. As shown in FIG. 1, when lever arm 62 is in the lower position indicated at I, take-up drum 26 is not rotating. As the web is indexed through the labeling machine as dictated by the operation of stepper motor 52 and driver roller 50, lever arm 62 moves from the lower position I pivotally upwardly to an upper position indicated at II. When lever arm 62 reaches upper position II, a limit switch (not shown) activates the motor driving take-up drum 26 to begin rotating take-up drum 26 causing lever arm 62 to pivot downwardly back into the lower position I at which time take-up drum 26 stops rotating. Therefore, the pivoting action of lever arm 62 avoids the need to continuously operate take-up drum 26 or, alternatively, to intermittently cycle take-up drum 26 each time the web is indexed through metering roll 22.

Power dancer device 24 performs at least two important functions for accomplishing accurate metering and effective dispensing of labels. First, power dancer 24 maintains a constant load or tension in the web traveling between take-up drum 26 and driving and metering roll 22. Power dancer device 24 produces a substantially constant tension in web 12 by maintaining a substantially constant torque on lever arm 62 throughout its pivotal movement. As shown in FIG. 1, this substantially constant torque is achieved by positioning spring 76 relative to link 72 so that the force component of the total spring pulling force on link 72, which causes the rotation of link 72, that is, the rotational force component, increases as the spring force on spring 76 decreases during movement of lever arm 62. This rotational force component is that component of the total spring force which is tangential to the circular path of rotation of link 72 around the pivot axis at pin 66, which, in this case, is also perpendicular to link 72. As shown in FIG. 1, with lever arm 62 in the lower position I, the spring force pulling on link 72 acts at such an angle to link 72 to create both a radial force component (parallel to the longitudinal axis of link 72) and the rotational force component. Therefore, the total spring force is proportioned between the radial component and rotational (tangential) component based on the angle of the spring relative to link 72. As lever arm 62 moves from the lower position I to the upper position II during indexing of web 12 through metering roll 22, link 72 rotates towards spring 76. As lever arm 62 moves toward upper position II, the force applied by spring 76 gradually becomes more perpendicular to link 72 and tangential to the circular path of rotation of link 72 around pin 66 so that causing the rotational force component to increase relative to the radial force component. As a result, a greater portion of the total spring force of spring 76 is transmitted through link 72, pin 66, lever arm 62, and support roller 82 to the web. However, as link 72 moves towards spring 76, the total spring force decreases as the spring is relaxed towards its normal untensioned position. Therefore, the decrease in the total spring force applied to the link is compensated by the increase in the rotational force component's share of the total force spring force applied to the link due to the varying position of the spring relative to the link 72. It has been found that by positioning the spring 76 relative to link 72 so that the rotational force component's share of the total force acting on link 72 varies inversely to the changing spring force throughout the movement of lever arm 62, the resultant force by roller 82 on web 12 can be maintained substantially constant throughout the movement of lever arm 62 thereby maintaining tension in web 12 at a substantially constant level. By maintaining tension in the web between the take-up drum 26 and metering roll 22, power dancer 24 significantly reduces tension variations in the web downstream of the metering roll 22. As a result, metering roll 22 is able to more accurately and effectively meter or pull the web intermittently through the machine. Moreover, it has been found that tension variations downstream of metering roll 22 are transmitted through the web upstream of metering roll 22. Since maintaining optimum tension across peeler bar 44 is critical to the proper dispensing of labels, tension variations in the web adversely affect the ability of the peeler bar to dispense labels effectively. Power dancer 24 substantially reduces variations throughout the machine by maintaining tension in the web downstream of the metering device at a substantially constant level. Also, the need for maintaining substantially constant tension in the web increases as the web speed increases since at higher web speeds, metering roll 22 and peeler bar 24 are more sensitive to changes in web tension.

The second important function performed by power dancer 24 is as a driving means for pulling web 12 through the labeling machine from supply roll 16. As previously mentioned, metering roll 22 also functions as a driver for pulling the web through the labeling machine. For a given web size and a given driver, such as stepper motor 52, the motor 52 can be operated at maximum capacity to achieve a maximum driver pulling force resulting in a maximum web speed. To increase the web speed beyond the capacity of stepper motor 52, a new higher capacity, more expensive stepper motor or driving device would be needed. However, by using the power dancer 24 of the present invention, higher web speeds can be more effectively obtained with the existing driving and metering roll 22 and stepper motor 52 without undue costs. In order to create a significant driving force for assisting metering roll 22, spring 76 of power dancer 24 is chosen so as to apply a significant torque to lever arm 62 resulting in a significant pulling force on web 12 tending to pull the web through metering roll 22. This power dancer generated force may be at least 20%, and preferably approximately 50%, of the total force needed to pull the web through the labeling machine at a given speed. In this manner, both driving and metering roll 22 and power dancer 24 apply pulling forces on the web to pull the web through the machine. As a result, power dancer 24 reduces the driving load required by driving and metering roll 22. For example, if at a maximum capacity, driving and metering roll 22 is capable of pulling web 12 with a pulling force of 20 pounds, and power dancer 24 is set by choosing the appropriate spring to achieve a substantially constant force on web 12 immediately downstream of metering roll 22 of approximately 10 pounds, then the total pulling force on the web at dispensing unit 18 would be approximately 30 pounds each time the metering roll shifts into a driving mode to pull web 12 through the machine. This use of power dancer 24 as a driver for applying a significant pulling force to web 12 has two significant advantages. First, since power dancer 24 acts as a second driver, stepper motor 52 of driving and metering roll 22 can be operated at less than its full capacity to achieve the same web speed. Therefore, since the total pulling force on the web is greater due to the combination of drivers, a higher web speed can be achieved. For example, in the example described hereinabove, without power dancer 24, driving and metering roll 22 may operate at a first web speed corresponding to the maximum pulling force of 20 pounds. However, when combined with power dancer 24, the maximum pulling force on the web is 30 pounds; 10 pounds created by power dancer 24 and 20 pounds created by driving and metering roll 22 during the driving mode. It should be noted that during the braking mode of driving and metering roll 22 as it stops, stepper motor 52 operates to resist the pulling force of power dancer 24. However, although the tension upstream of driving and metering roll 22 increases and decreases with the operation of roll 22, the tension in the continuous web of material downstream of driving and metering roll 22 is maintained at a substantially constant level by power dancer 24 as described hereinabove.

The second major advantage achieved by utilizing power dancer 24 as a driver for applying a significant pulling force on web 12, is that power dancer 24 reduces the driving load required by driver and metering roll 22. The greater the driving requirements placed on the driving and metering roll 22, the more difficult it is for stepper motor 52 to accurately stop and start movement of the web. This metering effect is extremely important to the proper dispensing of labels, especially at high speeds at which the window of opportunity for precise starting and stopping is decreased substantially. By decreasing the driving load on the driving and metering roll 22, the present invention enables roll 22 and stepper motor 52 to more accurately and effectively perform its metering function. If driving and metering roll 22 is capable of achieving a given web speed with a maximum pulling force of 20 pounds, the same web speed can be achieved using the present invention by setting the power dancer to impart a pulling force of 10 pounds on the web from metering roll 22 and operating the stepper motor at half capacity so as to result in a total pulling force of 20 pounds during the driving mode of metering roll 22. Thus, the same web speed is achieved while reducing the driving load on driving and metering roll 22, thereby ultimately obtaining more accurate and effective metering and dispensing of labels.

Figure 3:
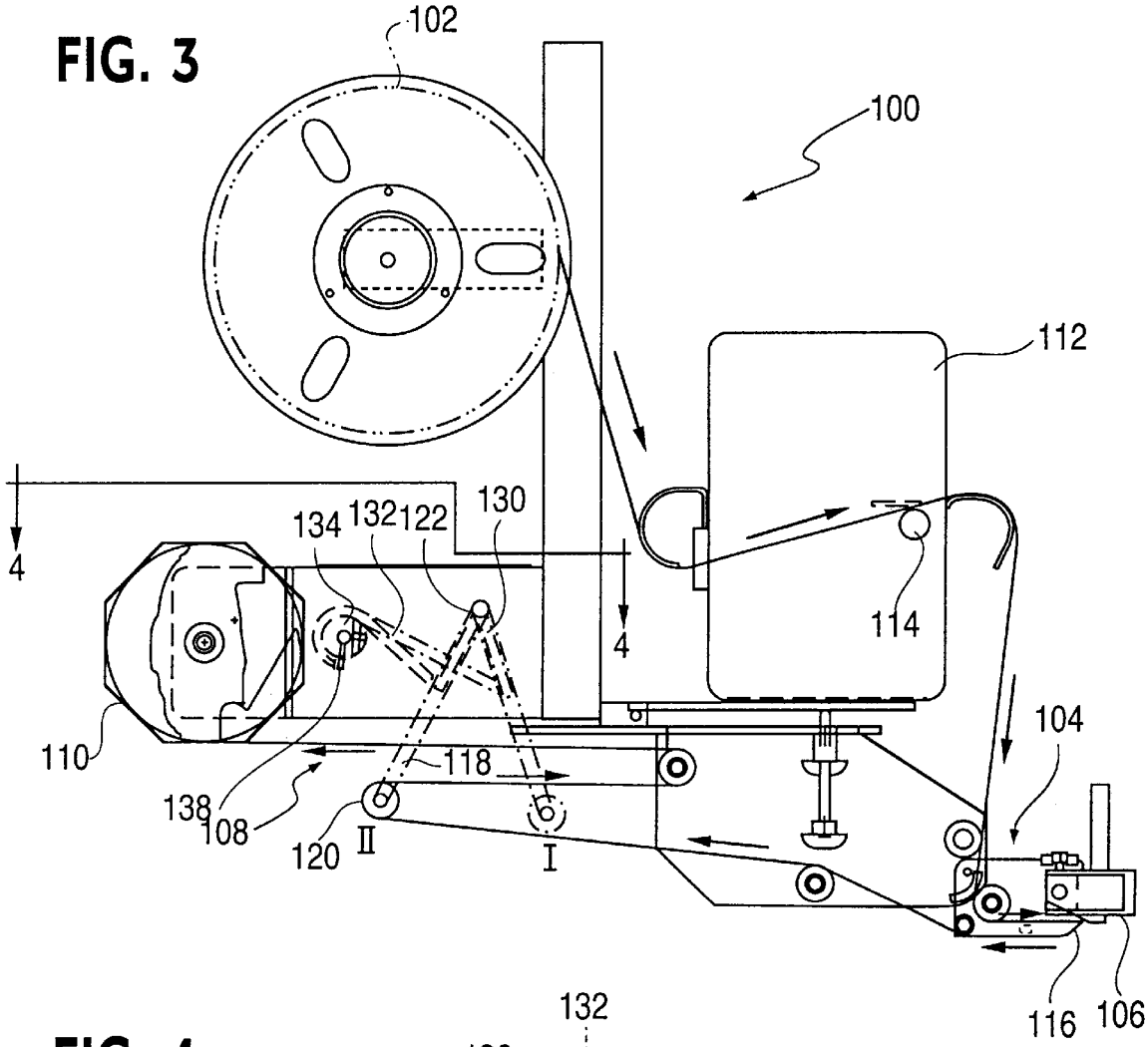
FIG. 3 is a front elevational view of a second embodiment of the high speed labeling machine of the present invention.
Figure 4:
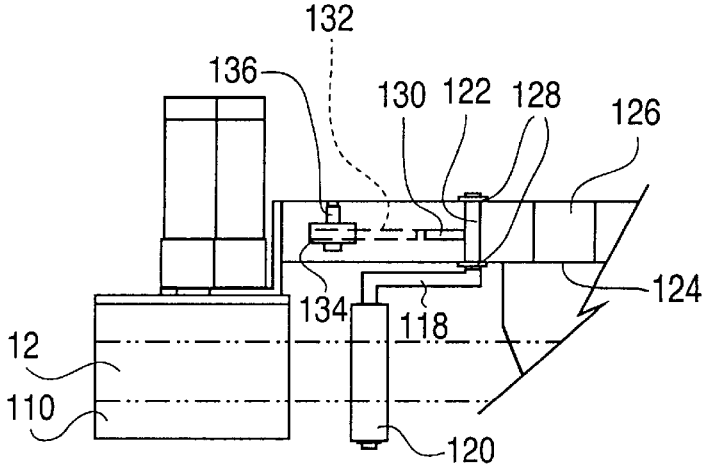
FIG. 4 is a top plan view of a second embodiment of the constant tensioning and driving device of the present invention taken along plane 4—4 of FIG. 3.

Referring to FIGS. 3 and 4, a second embodiment of the present invention is shown and includes a labeling machine similar to the previous embodiment in that a supply roll 102 of labels mounted on a web of backing material is supplied to a dispensing unit 104 and applicator 106 for applying labels to articles (not shown). Also, labeling machine 100 includes a power dancer device 108 and a talce-up drum 110. However, in this embodiment, a printer 112 is positioned along the feed path of the web between the supply roll 102 and dispenser 104 for printing indicia on the labels as the web passes through the printer. Printer 112 is typically an "off-the-shelf" printer having a built-in driving and metering roll 114 for pulling the web through the printer. However, it has been found that the driving and metering roll 114 of most printers are operated by small drivers, such as a low power stepper motor, lacking the power to effectively pull the web from the large supply roll 102 as used in large capacity labeling. The present invention assists driving and metering roll 114 by using power dancer 108 to create a pulling force in the web thereby alleviating the driving load on roll 114. As a result, the built-in driving and metering roll 114 of printer 112 can be used without incurring the costs and burden of modifying the machine to include a larger driving and metering roll or driving means. Moreover, power dancer 108 maintains tension in the web downstream of the driving and metering roll 114 at a substantially constant levels. Also, although the tension level in the web downstream of dispenser 104 will be larger than the tension immediately downstream of driving and metering roll 114 due to the frictional losses across peeler bar 116 of dispenser 104, dancer 108 also maintains the tension immediately downstream of peeler bar 116 at a substantially constant level. As discussed above in relation to the embodiment of FIG. 1, since the load on the driving and metering roll 114 is reduced and the tension in the web immediately downstream of roll 114 is maintained at a substantially constant level, more accurate metering of the web can be achieved. In this embodiment, improvements in metering translates into improvements in the printing of labels by the printer. In addition, the substantially constant tension level at the peeler bar permits more effective dispensing of labels.

Referring to FIGS. 3 and 4, power dancer 108, although structurally different from that of the previous embodiment, functions substantially in the same manner to maintain tension in the web downstream of metering roll 114 at a substantially constant level while providing a driving pulling force on the web. Power dancer 108 includes a pivotable lever arm 118 having a rotatable roller 120 attached to one end thereof for pivotable movement between a first position I and a second position II. The opposite end of lever arm 118 includes a pin 122 extending perpendicular from lever arm 118 transversely through a first wall 124 and a second wall 126. Pin 122 is supported by bearings 128 attached to each wall for allowing pin 122 to freely rotate. A link 130 is rigidly attached at one end to pin 122 so that movement of lever arm 118 rotates link 130. The opposite end of link 130 includes a small hole (not shown) for attachment to one end of a spring 132. The opposite end of spring 132 is positioned in a U-shaped groove formed in the outer circumferential portion of a wheel 134 mounted on a rod 136 extending from second wall 126 toward first wall 124. A threaded pin 138 extends radially outward from wheel 134 for connection with the end of spring 132. Wheel 134 is rotatably adjustable into a variety of locked positions to allow the tension in spring 132 to be varied to achieve the optimum driving force while still maintaining a substantially constant tension level throughout the movement of lever arm 118. As can be seen in FIG. 3, as lever arm 118 moves toward the second position II, the force applied by spring 132 gradually becomes more tangential to the axis of rotation around pin 122 so that a greater portion of the total spring force is used to rotate lever arm 118. However, as with the previous embodiment, as link 130 moves towards spring 132, the total spring force decreases as the spring is relaxed towards its normal untensioned position. Therefore, the increase in the rotational force due to the varying position of the spring 132 relative to the link 130 is compensated by the decrease in the total spring force applied to the link. Therefore, by positioning wheel 134 and therefore spring 132 relative to link 130 so that the rotational force component's share of the total force acting on link 130 varies inversely to the changing spring force throughout the movement of lever arm 118, the resultant torque and, therefore, the resultant force by roller 120 on web 12 can be maintained substantially constant throughout the movement of lever arm 118, thereby maintaining tension in the web at a substantially constant level.

INDUSTRIAL APPLICABILITY

The disclosed high speed labeling machine having a constant tension driving system finds particular utility when positioned along a conveyer as a labeling station in a manufacturing, distribution, or packaging application. The high speed labeling machine of the present invention is especially useful in labeling and printing applications in which effective and accurate metering and dispensing of labels is a priority.

We claim:

1. A labeling machine for dispensing labels from a continuous web of material traveling along a feed path and applying the labels to a plurality of articles, comprising:

a supply means for providing a supply of the continuous web of material having the labels affixed thereto;

a dispensing means positioned along said feed path downstream of said supply means for removing a label from the continuous web of material for application to the article;

a metering means positioned along said feed path for metering the continuous web of material from said supply means; and a constant tensioning means positioned along said feed path downstream of said metering means for maintaining tension in the continuous web of material immediately downstream of said metering means at a substantially constant predetermined level said constant tensioning means including a lever arm having a first portion pivotable between a first position and a second position, an abutment means mounted on said first portion for abutting the continuous web of material and a biasing means operatively connected to said lever arm for biasing said lever arm toward said second position, said biasing means capable of imparting a total biasing force on said lever arm, said total biasing force decreasing as said lever arm moves from said first position to said second position, said total biasing force including a rotational force causing said lever arm to pivot, said constant tensioning means capable of maintaining said rotational force substantially constant throughout movement of said lever arm from said first position to said second position so as to maintain tension in the continuous web of material at a substantially constant predetermined level.

2. The labeling machine of claim 1, further including an accumulating means position downstream of said dispensing means for accumulating the continuous web of material, said constant tensioning means capable of maintaining tension in the continuous web of material along said feed path between said metering means and said accumulating means at substantially constant predetermined levels.

3. The labeling machine of claim 2, wherein said accumulating means includes a take-up drum, said constant tensioning means positioned along said feed path between said dispensing means and said take-up drum.

4. The labeling machine of claim 2, wherein said metering means is positioned along said feed path between said supply means and said dispensing means.

5. The labeling machine of claim 4, further including a printing means positioned upstream of said dispensing means for printing indicia on the labels.

6. The labeling machine of claim 2, wherein said metering means is positioned along said feed path between said dispensing means and said accumulating means.

7. The labeling machine of claim 2, wherein said constant tensioning means imparts a constant pulling force on the continuous web of material necessary for pulling the continuous web of material from said supply means at a specified web speed.

8. The labeling machine of claim 7, wherein a total pulling force is required to pull the continuous web of material through the labeling machine at a predetermined web speed, said metering means being operable in a driving mode for imparting a driver pulling force on the continuous web of material for pulling the continuous web of material from said supply means and a braking mode for stopping movement of the continuous web of material through the labeling machine, wherein said total pulling force equals the sum of said constant pulling force and said driver pulling force.

9. The labeling machine of claim 8, wherein said metering means is capable of imparting a predetermined maximum driver pulling force, said constant pulling force being equal to approximately one-half of said maximum driver pulling force.

10. The labeling machine of claim 7, wherein said constant tensioning means includes an abutment means for abutting the continuous web of material and a biasing means for biasing said abutment means against the continuous web of material with a biasing force sufficient to create said constant pulling force.

11. The labeling machine of claim 10, wherein said constant tensioning means further includes a lever arm including a first portion pivotable between a first position and a second position and a second portion spaced from said first portion, said abutment means including a roller mounted on said first portion for supporting the continuous web of material, said biasing means including a coil spring operatively connected to said lever arm for biasing said first portion towards said second position to maintain said substantially constant predetermined tension level in the continuous web of material.

12. The labeling machine of claim 11, wherein said accumulating means further includes a take-up drum arranged to receive the continuous web of material from said constant tensioning means and operable to move said first pivotable portion of said lever arm from said second position to said first position.

13. The labeling machine of claim 12, wherein said dispensing means includes a peeler bar, said peeler bar including a peeling edge for contacting the continuous web of material to cause the label to dispense from the continuous web of material, the continuous web of material including an entering portion moving towards said peeling edge immediately adjacent said peeling edge and an exiting portion moving away from said peeling edge immediately adjacent said peeling edge, said peeler bar further including a rotatable roller positioned immediately adjacent said peeler bar for supporting said exiting portion.

14. A labeling machine for dispensing labels from a continuous web of material pulled along a feed path and applying the labels to a plurality of articles, comprising:

a supply means for providing a supply of the continuous web of material having the labels affixed thereto;

a dispensing means for removing a label from the continuous web of material for application to the article;

a first driving means positioned along said feed path downstream of said supply means for imparting a first pulling force on the continuous web of material said first driving means including a metering means for metering the continuous web of material from said supply means; and a second driving means positioned along said feed path downstream of said first driving means for imparting a second pulling force on the continuous web of material for pulling the continuous web of material from said supply means and for maintaining tension in the continuous web of material immediately downstream of said first driving means at a substantially constant predetermined level, said second driving means including a lever arm positioned in abutment with the continuous web of material and pivotable between first and second positions, and a biasing means operatively connected to said lever arm for biasing said lever arm toward said second position to create said second pulling force, wherein a total pulling force is required to pull the continuous web of material through the labeling machine at a predetermined web speed, said second pulling force being at least 20% of said total pulling force.

15. The labeling machine of claim 14, further including an accumulating means positioned downstream of said dispensing means for accumulating the continuous web of material, said second driving means capable of maintaining tension in the continuous web along said feed path between said metering means and said accumulating means at substantially constant predetermined levels.

16. The labeling machine of claim 15, wherein said accumulating means includes a take-up drum, said second driving means positioned along said feed path between said dispensing means and said take-up drum.

17. The labeling machine of claim 15, wherein said metering means is positioned along said feed path between said supply means and said dispensing means.

18. The labeling machine of claim 17, further including a printing means positioned adjacent said metering means for printing indicia on the labels.

19. The labeling machine of claim 15, wherein said metering means is positioned along said feed path between said dispensing means and said accumulating means.

20. The labeling machine of claim 14, wherein said first driving means is capable of imparting a predetermined maximum driver pulling force, said second pulling force being equal to at least 20% of said maximum driver pulling force.

21. The labeling machine of claim 14, wherein said second driving means includes an abutment means for supporting the continuous web of material and a biasing means for biasing said abutment means against the continuous web of material with a biasing force sufficient to create said second pulling force.

* * * * *